United States Patent [19]

Thompson et al.

[11] 4,258,947

[45] Mar. 31, 1981

[54] HANDLE ATTACHMENT FOR BOWLING BALL

[76] Inventors: Donald C. Thompson, 2720 Buttonwillow, Stockton, Calif. 95207; Richard L. Cross, 1027 Aldwina; Jimmie Rose, El Rancho Mobile Home Park, both of Manteca, Calif. 95336

[21] Appl. No.: 54,977

[22] Filed: Jul. 5, 1979

[51] Int. Cl.[3] ..... A65G 7/00; A63B 43/02

[52] U.S. Cl. ..... 294/15; 273/64

[58] Field of Search ..... 273/64, 54 R, 54 B; 215/358; 294/25, 26, 15; 220/238

[56] References Cited

U.S. PATENT DOCUMENTS

| | | | |
|---|---|---|---|
| 2,738,192 | 3/1956 | Wells | 273/64 |
| 2,822,108 | 2/1958 | Moeller | 220/238 |

FOREIGN PATENT DOCUMENTS

| | | | |
|---|---|---|---|
| 876342 | 5/1953 | Fed. Rep. of Germany | 215/358 |

*Primary Examiner*—George J. Marlo

*Attorney, Agent, or Firm*—David B. Harrison

[57] ABSTRACT

A handle attachment for a bowling ball includes a hand grip, a shank extending from the grip and a radially expansible plug extending from the shank. A mechanism for changing the length and therefore the radius of the plug between a locking position and a release position is controllable at the grip in a way that locks the mechanism in the locking position when the grip is grasped by the hand as in carrying a bowling ball. In the release position, the plug is inserted into and withdrawn from the thumb hole of the ball, and in the locking position the plug securely engages the sidewall defining the thumb hole thereby attaching the handle attachment securely to the bowling ball.

5 Claims, 4 Drawing Figures

HANDLE ATTACHMENT FOR BOWLING BALL

BACKGROUND OF THE INVENTION

The present invention relates to a handle attachment for transporting a bowling ball when not actually in play. More particularly, the present invention relates to a handle attachment which releasably engages the sidewall defining a thumb or finger hole of the bowling ball.

A well known way to transport a bowling ball to and from the bowling lane has been in a carrying case. While such carrying cases have worked satisfactorily, they have not satisfied the need for a way to carry the ball efficiently, yet comfortably, in a manner that enables the ball to be ready for play at any time.

For years, bottle caps have been known which utilize a radially expansible and retractable plug to effect a seal. The present invention adapts that type of plug in a unique way to facilitate a secure yet releasable handle attachment for a bowling ball.

SUMMARY OF THE INVENTION WITH SOME OBJECTS THEREOF

One object of the present invention is to provide a releasable handle attachment for a bowling ball.

Another object of the present invention is to provide a bowling ball handle attachment which releasably engages the interior sidewall defining a thumb hole, a finger hole and the like in a bowling ball.

A further object of the present invention is to provide a bowling ball handle attachment which is retained in a locked on position while in use.

These and other objects are accomplished by a bowling ball handle attachment which includes a hand grip, a shank extending from the grip, and a radially expansible generally cylindrical plug at the end of the shank. A locking mechanism for changing the length and thus the cylindrical radius of the plug between a locking position and a release position is controllable at the grip in a way that locks the mechanism in the locking position when the grip is grasped by the hand when, for example, the bowling ball is being carried with the aid of the handle attachment of this invention. In the release position, the plug is freely insertable into and withdrawable from the thumb hole of the ball. In the locking position, the plug securely engages the sidewall defining the thumb hole thereby securing the handle attachment to the bowling ball.

Other objects, advantages and features of the present invention will become apparent from a consideration of a preferred embodiment presented along with the accompanying drawings.

DETAILED DESCRIPTION OF A PREFERRED EMBODIMENT

Figure 1:
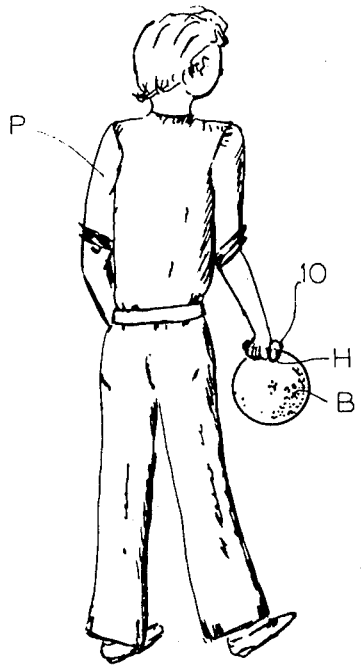
FIG. 1 is a diagrammatic view of a player transporting a bowling ball with a handle attachment in accordance with the present invention.

In FIG. 1 a bowling ball B is shown being transported to or from a bowling lane by a player P. The player P is grasping a handle attachment 10 attached to the bowling ball B in accordance with the present invention.

Figure 2:
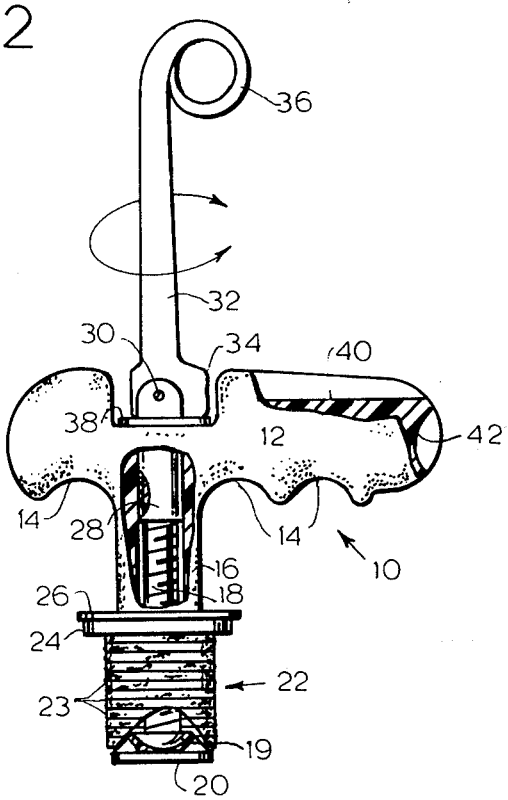
FIG. 2 is a diagrammatic view in side elevation of the handle attachment of FIG. 1 with the release lever in a vertical position for adjustment of the plug and with a portion thereof broken away.

In FIG. 2 the handle attachment 10 includes a handle portion 12 provided with finger contouring 14 to accommodate comfortably the fingers and thumb of the player P. Preferably, the contouring 14 is designed so that the handle attachment 10 may be comfortably grasped by either the right or left hand. Preferably formed integrally with the handle portion 12 is a downwardly extending perpendicular shank 16. The shank 16 has a central cylindrical passage along its axis in which a threaded bolt 18 is slideably positioned. The handle portion or grip 12 and the shank 16 may be injection molded of a high impact, high density plastic material such a polystyrene.

Figure 3:
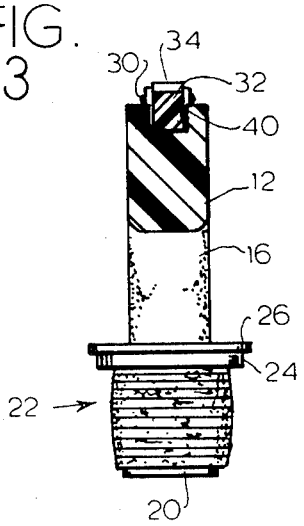
FIG. 3 is a diagrammatic view in end elevation of the handle attachment of FIG. 1 wherein the plug portion has been compressed slightly in order to fit within a particular diameter thumb hole in a bowling ball.
Figure 4:
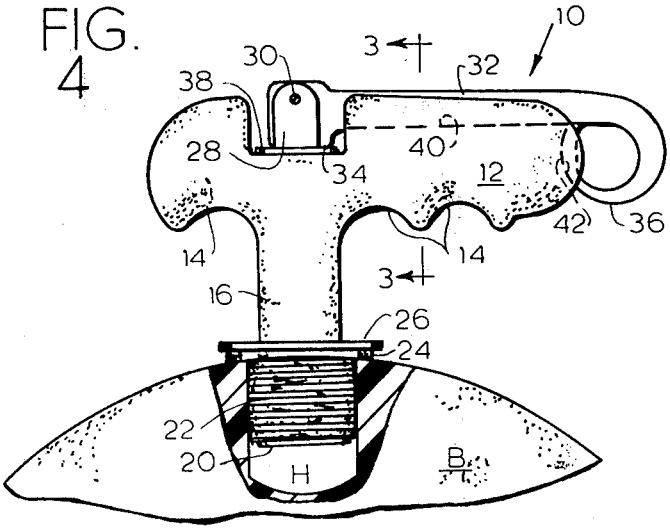
FIG. 4 is a diagrammatic view in side elevation of the handle attachment of FIG. 1 in a locked position engaging the sidewall of the thumb hole of a bowling ball.

The threaded bolt 18 is provided with a head 19 which engages a recessed portion of a compression washer 20. The washer 20 retains a generally cylindrical elastomeric plug 22 against the shank 16. The plug 22 is provided with a series of annular projections or recesses 23 similar to tire treads so as to improve the gripping qualities of the plug 22. The plug 22 expands radially under compression as shown in FIG. 3. An upper elastomeric annular portion 24 is formed at the end opposite that against the washer 20. The portion 24 may be integral with the plug 22 and functions to conform to the peripheral contour of the bowling ball B at the thumb hole as shown in FIG. 4. A finger hole may be used as well as a thumb although the latter is typically provided to a greater depth into the ball.

A metal washer 26 is placed between the stem 16 and the plug 22. An inside threaded sleeve 28 mates with the threads of the bolt 18 as shown in the broken away portion of FIG. 2. The sleeve 28 terminates at its upper end in a forked arrangement through which passes a pivot pin 30.

A rotatable camming lever 32 positioned between the forks of the upper end of the sleeve 28, is held in place by the pivot pin 30. The camming lever 32 is characterized by a camming surface 34 close to the pivot pin 30 and by a locking spring 36 at the end opposite the camming surface. A washer 38 around the sleeve 28 just below the forks thereof provides a durable operating surface for the camming surface 34. When the lever 32 is in the upright, uncammed (FIG. 2) position, it may be freely rotated and with it the sleeve 28 which then moves axially relative to the bolt 18 in accordance with the direction of rotation. In this way, the compression on the plug 22 (and its initial diameter) may be adjusted so that the plug fits closely but freely within the thumb hold H of the bowling ball B. The effect of this adjustment is illustrated by outward bowing of the plug 22 shown in FIG. 3.

One the adjustment for correct fit in the thumb hole is made, then after the plug 22 is in the thumb hole H, the lever 36 is moved to a seated locking position within a peripheral groove 40 of the handle 12. The longitudinal groove 40 holds the lever 32 in place, while a locking recess 42 at the end of the handle 12 engages the spring end 36 of the lever to provide a further lock. The flatness of the cam surface 34 provides a third locking mechanism.

In the locked in place position of the handle attachment 10 shown in FIG. 4, the sleeve 28 has pulled the bolt upwardly which was caused the plug 22 to expand radially and compress tightly and securely against the sidewall of the thumb hole H of the bowling ball B as shown as a fragmented portion in section in FIG. 4.

In use, the handle attachment 10 is adjusted to the size of the thumb hole by rotating the lever 32 in a direction which expands or contracts the peripheral dimension of the plug 22 so that it snugly yet freely slides into and out of the thumb hole H of the particular bowling ball B for which the handle attachment 10 will be utilized. It is to be understood that as there are several commonly utilized diametral dimensions for thumb holes for bowling balls, there will be a range of plugs 22 available to accommodate those dimensions. The plug 22 may be readily exchanged for another size by simply unscrewing the bolt 18 from the sleeve member 28 and then replacing the plug 22 with another one more appropriate to the size of the particular thumb hole H of the bowling ball B with which the attachment handle 10 will be utilized. In this way, a wide range of thumb hole sizes is readily accommodated by the attachment 10.

Once the attachment 10 is adjusted to the diametral size of the thumb hole H, then the attachment 10 may be locked in place by the downward movement of the handle 32 into its locked position within the longitudinal groove 40 and snap locked by the action of the spring portion 36 engaging the arcuate slot 42 at the far end of the rib portion 12 of the handle attachment.

While the bowling ball is being transported by use of the handle attachment 10, it is apparent that the bowler's hand will hold the cammed lever 32 in place in the longitudinal channel 40 and the camming surface 34 as well as the spring lock 36 will serve as locking mechanisms to hold the handle attachment 10 securely in its intended engagement with the bowling ball B while it is being transported. Yet, the attachment 10 is freely disengaged from the bowling ball by simply lifting the lever 32 as by grasping the spring 36 and pulling upwardly, whereupon the plug 22 relaxes and contracts radially thereby enabling the attachment 10 to be easily withdrawn from the thumb hole H.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

We claim:

1. A handle attachment for transporting a bowling ball provided with and defining a thumb or finger hole, said attachment comprising:

a hand grip;

a shank extending from the grip;

a radially expansible, generally cylindrical plug at the end of the shank opposite the grip, said plug being the only point of support between the handle and the bowling ball;

plug expansion and contraction control means extending through the plug, shank and grip for changing the length and therefore the radius of the plug between a self-locking position and a release position, whereby the plug may be freely inserted into and withdrawn from the thumb hole of the bowling ball in the release position and will securely engage the sidewall defining the thumb hole in the locking position so as to provide a secure yet releasable engagement between the handle attachment and the bowling ball.

2. A handle for detachably engaging a sidewall of a thumb or finger hole in a bowling ball, said handle comprising:

a hand grip portion having contouring adapted to the features of a palm and fingers in a gripping posture;

a shank portion extending from said hand grip portion;

a radially expansible plug portion at the end of said shank portion, said plug portion having a radially expanded engagement position for engaging the thumb hole sidewall and a radially contracted position for facilitating insertion and removal of the handle relative to the bowling ball, the only point of support between the handle and bowling ball being said plug;

a plug control mechanism operable at the grip portion and connected through the shank portion for operating said plug portion between said engagement position and said contracted position;

whereby the plug portion may be freely inserted into and withdrawn from the thumb hole of the bowling ball in the contracted position and will securely engage the sidewall defining the thumb hole in the engagement position so as to provide a secure yet releasable engagement between the handle and the bowling ball.

3. An adjustable handle assembly for bowling balls with various finger hole sizes comprising:

a hand grip having contouring for a hand in a gripping posture;

a shank portion extending downward from the hand grip;

a rigid annular flange at the lower end of the shank portion;

a radially expansible generally cylindrical plug of elastomeric material adjacently below the rigid flange and in axial alignment with the shank;

a rigid surface at the bottom end of the plug;

a threaded shaft seated against said surface and passing through central axial passages in the plug and the shank;

a threaded member engaging the threads of said threaded shaft, said threaded member pivotally joined to a lever at the top of said hand grip;

a rotatable, pivotable lever having an eccentric camming surface portion adjacent to a pivotal joint with said threaded member, said camming portion engaging a top portion of said grip;

said grip having a longitudinal channel in the top thereof for receiving and locking said lever when it is in a cammed position;

said lever being rotatable in an uncammed position in general axial alignment with said member so as to move said threaded shaft and thereby adjust the radial dimension of said plug to fit snugly yet freely within a particular thumb or finger hole of a bowling ball and said lever being pivotable to a cammed position in longitudinal alignment with said hand grip and seated within said longitudinal channel, whereby said plug is expanded by the camming action to lock securely against the sidewall of the thumb or finger hole of the bowling ball.

4. The handle assembly set forth in claim 3 wherein said plug is provided with an annular tread to increase engagement between the sidewall and the radially expanded plug.

5. The handle assembly set forth in claim 3 wherein said hand grip includes a locking receptacle at the distant end of said longitudinal channel and said lever includes a locking mechanism at the end opposite the pivoted end, for releasably locking to said locking receptacle.

* * * * *